US007281498B2

(12) United States Patent
Besik

(10) Patent No.: US 7,281,498 B2
(45) Date of Patent: Oct. 16, 2007

(54) COMPACT HIGH EFFICIENCY GAS FIRED STEAM GENERATOR-HUMIDIFIER

(76) Inventor: Ferdinand K. Besik, 2562 Oshkin Crt., Mississauga, Ontario (CA) L5N 3Z3

( * ) Notice: Subject to any disclaimer, the term of this patent is extended or adjusted under 35 U.S.C. 154(b) by 157 days.

(21) Appl. No.: 11/267,603

(22) Filed: Nov. 7, 2005

(65) Prior Publication Data

US 2006/0249099 A1 Nov. 9, 2006

Related U.S. Application Data

(63) Continuation-in-part of application No. 08/657,179, filed on Jun. 3, 1996, now abandoned, and a continuation-in-part of application No. 09/419,577, filed on Oct. 18, 1999, now Pat. No. 6,305,612, and a continuation-in-part of application No. 09/835,774, filed on Apr. 16, 2001, now Pat. No. 6,397,788.

(51) Int. Cl.
*F16T 1/38* (2006.01)

(52) U.S. Cl. ..... 122/367.3; 122/491

(58) Field of Classification Search ..... 122/31.1, 122/33, 36, 367.3, 414, 479.2, 488, 491, 122/368

See application file for complete search history.

(56) References Cited

U.S. PATENT DOCUMENTS 4,388,892 A * 6/1983 Rody et al. ..... 122/4 D
5,161,488 A * 11/1992 Natter ..... 122/1 R
6,578,830 B2 * 6/2003 Watts ..... 261/141

* cited by examiner

*Primary Examiner*—Gregory Wilson

(57) ABSTRACT

A compact gas fired steam generator comprises a water tank with designated steam separation zone, boiling zone and a solids separation zone, a burner for burning gaseous fuel with air for producing combustion products and a flat tubular type heat exchanger immersed in water in the water tank. The combustion products are passing through the heat exchanger in an indirect heat transfer relationship with water in boiling zone thereby boiling, circulating and evaporating the water in boiling zone and in an indirect heat transfer relationship with cold make up water passing upwardly through solids separation zone thereby preheating cold make up water and cooling combustion products and recovering latent heat and condensing moisture present in combustion products. The cooled combustion products are discharged to outdoors and the collected condensed moisture is discharged to drain.

The produced steam is separated from the boiling water in steam separation zone, the solids present in the boiling water are separated from the circulating boiling water and accumulated in solids separation zone and the accumulated solids are cooled by the incoming cold make up water and intermittently discharged from solids separation zone by a water pump together with the incoming cold make up water to drain.

The high rate internal circulation of boiling water, the extended self cleaning heat transfer surfaces of the flat tubular type heat exchanger immersed in the boiling water, the recovery of latent heat from flue gases and the discharge of cooled solids with cold make up water provide an exceptionally compact steam generator with overall thermal efficiency of up to 95% and with maintenance free unattended operation.

The compact steam generator can be used in humidifying of space air in buildings, in heating of air in domestic central air heating systems and in industrial processes requiring clean steam.

20 Claims, 3 Drawing Sheets

COMPACT HIGH EFFICIENCY GAS FIRED STEAM GENERATOR-HUMIDIFIER

CROSS-REFERENCE TO RELATED APPLICATION

This Application is a continuation-in-part of my earlier application Ser. No. 08/657,179 entitled Compact Gas Fired Steam Generator, filed Jun. 3, 1996 now abandoned, Ser. No. 09/419,577 entitled Compact Gas Fired Humidifier, filed Oct. 18, 1999 now U.S. Pat. No. 6,305,612 and Ser. No. 09/835,774 entitled Compact ultra high efficiency gas fired steam generator, filed Apr. 16, 2001 now U.S. Pat. No. 6,397,788.

FIELD OF INVENTION

The present invention relates to a compact water tank type steam generator and a method for producing steam from feed water containing dissolved solids. The compact steam generator produces atmospheric or low pressure steam for use in humidifying of space air in buildings, in heating of air in domestic central air heating systems and in industrial processes requiring clean steam.

BACKGROUND

To carry out many industrial processes and manufacturing operations it is often necessary to maintain the temperature and humidity of the working environment at specific preset temperature—humidity conditions or use clean steam in a process operation. In heating of homes and buildings low pressure steam is often used to heat the air in the central air heating systems.

In the forced air heating, ventilation and air conditioning of industrial, commercial, institutional and residential buildings the required humidity of the space air is most conveniently maintained by addition of the atmospheric steam into the recirculating space air. For such humidifying of air the generation of the atmospheric or low pressure steam on site is the most economic and often the only available alternative.

Technical and commercial literature indicate, that the current art compact isothermic humidifiers are producing the atmospheric steam by boiling and evaporating the make up water at a substantially atmospheric pressure in sealed water tanks. The required heat is produced either by electric power via two or more electrodes or resistance heating elements submerged in the boiling water, or by a pressure steam delivered from a central steam boiler to a submerged heat exchanger, or by combustion of natural gas in immersion tube burners in water tanks.

Disclosed in U.S. Pat. No. 5,816,496 is a gas fired steam generator—humidifier with an integrated combustion chamber—heat exchanger immersed in a rectangular water tank. It operates at substantially atmospheric pressure with a periodic flow of the make up water and a steam generation process including two operating periods. The first operating period involves steps including transfer of heat from the heat source into the boiling water, evaporation of the boiling water, concentration of dissolved solids in boiling water, separation of the produced steam from the boiling water and discharge of the produced steam from the water tank. The following second operating period, in addition to the above steps, includes filling up the water tank with make up water, heating the make up water to its boiling temperature and draining of a portion of the boiling water to maintain the concentration of dissolved solids in boiling water within a preselected concentration limits Disclosed in my earlier application Ser. No. 08/657,179 entitled Compact Gas Fired Steam Generator, filed Jun. 3, 1996 and Ser. No. 09/419,577 entitled Compact Gas Fired Humidifier, filed Oct. 18, 1999 is a steam generator integrating a water tank with a tubular type boiler with a high rate internal reticulation of boiling water operating with a variable water level in the water tank, with a periodic flow of incoming make up water and with periodic blow down of boiling water with precipitated dissolved solids.

Disclosed in my earlier application Ser. No. 09/835,774, filed Apr. 16, 2001 entitled Compact Ultra High Efficiency Gas Fired Steam Generator is a compact gas fired steam generator integrating a water tank with a tubular type boiler with a high rate internal reticulation of boiling water operating with a constant water level in the water tank, with a substantially constant flow of incoming make up water, with a substantially constant blow down of boiling water with precipitated dissolved solids and with a condensing heat exchanger recovering latent heat from flue gases and with a heat exchanger recovering waste heat from the blow down boiling water.

The current art gas fired steam generators used in humidifiers available from Nortec Industries, Amstrong International, Inc. and DriSteem Humidifier Company produce steam from cold make up water in response to humidity demand of the air measured and controlled by a humidistat. They may produce the steam in cycles comprising an ON period followed by an OFF period maintained by an ON-OFF humidistat, or continuously at a variable rate on call from a modulating humidistat.

The used make up water may be a city water, softened water, deionized water (DI) or reverse osmosis treated water (RO). Most often the make up water is a city water containing dissolved solids and its flow into the water tank may be either substantially continuous or intermittent maintained by a suitable float valve or by a float switch operating a solenoid valve. As the feed water is converted to steam, impurities which enter with make up water are concentrated and the concentrated dissolved solids such as calcium and magnesium precipitate. Portion of precipitated solids accumulates as hard scale on the submerged heat transfer surfaces, the remainder settles out and accumulates on the bottom of the water tank which must be regularly cleaned to maintain its operation.

To minimise build up of hard scale on the heat transfer surfaces, the current art humidifying systems drain a portion of the boiling water to maintain the concentration of dissolved solids in boiling water within a preselected concentration limits or use ionic beds (Armstrong) that must be regularly replaced.

The overall thermal efficiency of the current art gas fired steam generator used in humidifiers is low and in the range of 75%-80%.

To provide the required heat transfer area, the current art gas fired steam generators require relatively large water tanks with large volume of boiling water to accommodate the required heat transfer surfaces causing a delayed response in steam production.

To protect the water tank against an accidental increase in operating pressure the steam generators are provided either with a water seal or a pressure relief valve. The water seal also provides for regular periodic overflow of the blow down boiling water while preventing steam from escaping through the overflow outlet. With such overflow water seal arrangement, the steam pressure in the tank is limited by the height of the water seal column in the overflow tube.

The method of production of steam in current art gas fired steam generators involves steps including: feeding cold make up water into the water tank, burning fuel with air to produce combustion products, transferring heat from combustion products by heat exchanger immersed in the boiling water to preheat and boil the make up water to produce steam, concentrating and precipitating dissolved solids in boiling water or removing dissolved solids by ionic beds (Amstrong), separating the produced steam from boiling water, discharging the produced steam from water tank, regularly blowing down boiling water to maintain an acceptable concentration of dissolved and suspended solids in boiling water, regular cleaning of heat transfer surfaces and replacing the ionic beds and regular removal of accumulated solids from the water tank.

There are three groups of controls that are integrated to maintain the operation of the current art gas fired humidifying systems fully automatic. These include: a) humidifying controls regulating the humidity of air, b) combustion controls regulating the combustion of fuel in response to humidity demand of the air and c) the water controls regulating the flow of make up water, water level in water tank, blow down of the boiling water, and draining of the water tank. Monitoring and display of selected performance parameters is also provided with some current art systems.

A major concern with the current art gas fired steam generators are the large water tanks with a delayed response in steam production, high initial cost, high operation maintenance cost, excessive consumption of water due to required regular blow down of boiling water and low overall thermal efficiency.

The delayed response in steam production is due to large water tanks required by the heat transfer surfaces, the high initial cost is due to use of relatively large stainless steel water tanks and large stainless steel heat exchangers, the high operation maintenance cost is due to required regular cleaning of heat transfer surfaces and replacement of ionic beds or manual removal of accumulated settled solids from water tanks and the low overall thermal efficiency is due to regular blow down of boiling water and low combustion efficiency due to loss of latent heat with discharged combustion products.

Therefore, to overcome the shortcomings of the current art fuel fired steam generators the object of the present invention is to provide a compact steam generator and a method for producing steam from cold make up water containing dissolved solids with reduced volume of boiling water in the water tank, with a heat exchanger submerged in the water having extended heat transfer surfaces with reduced heat transfer resistance on the side of combustion products and with reduced build up of hard scale, with recovery of latent heat from cooled combustion products without the need for an additional heat exchanger and without the need for the regular blow down of boiling water or use of ionic beds and without the need for regular manual removal of settled solids.

BRIEF DESCRIPTION OF THE INVENTION

Briefly, and in general terms, the present invention provides an improved compact gas fired water tank-steam generator and a method for producing a continuous stream of clean atmospheric or low pressure steam from cold make up water containing dissolved solids. It offers an overall thermal efficiency of up to 95% and unattended automatic maintenance free operation. It is intended for use in humidifying of space air in various heating-ventilation-airconditioning systems of buildings, in heating of space air in residential central air heating systems and in industrial processes requiring clean low pressure steam.

The compact gas fired steam generator comprises a water tank with a designated steam separation zone, boiling zone and a solids separation zone, a burner for burning gaseous fuel with air for producing combustion products, a vertical flat tubular type heat exchanger located in the boiling zone and extending into the solids separation zone, with combustion products passing downwardly through the heat exchanger in an indirect heat transfer relationship first with the water in the boiling zone thereby boiling and circulating the water and producing steam and cooling the combustion products, then in indirect heat transfer relation ship with cold make up water passing upwardly through solids separation zone to boiling zone thereby recovering latent heat by preheating cold make up water and condensing the moisture present in combustion products. The cooled combustion products are discharged to outdoors and the collected condensed moisture is disposed to sewer.

The water level in the steam separation chamber is maintained at a substantially constant water level by a float switch operating a solenoid valve with a flow restricting orifice. The flow of cold make up water, the production of steam, the separation of the precipitated dissolved solids from circulating boiling water and cooling of accumulated solids with incoming cold make up water are substantially continuous.

The produced steam is separated from the boiling water in the steam separation zone, the solids are separated from the circulating boiling water and accumulated and cooled by the incoming cold make up water in the solids separation zone and the cooled solids are intermittently discharged from the solids separation zone by a water pump together with the incoming cold make up water to drain. There is no blow down of boiling water.

The high rate internal circulation of boiling water, the extended self cleaning heat transfer surfaces of the flat tubular type heat exchanger immersed in the water and the automatic discharge of cooled solids with cold make up water provide an exceptionally compact steam generator with maintenance free unattended operation.

Another aspect of the present invention is an optional operation of the compact steam generator at a negative pressure in the combustion chamber to prevent leakage of combustion products into the building and to permit addition of dilution air to the cooled combustion products to lower their dew point to eliminate condensation of moisture in flue duct.

Still another aspect of the present invention is an optional operation of the compact steam generator to produce steam for heating of air in residential central air heating systems.

These and other features and advantages of this invention will become apparent upon reading the following specification, which along with the drawings describes and discloses preferred embodiments of the invention in detail with the drawings illustrating in schematic form the combination of a compact steam generator of this invention with a typical air humidifying system in humidifying of space air.

BRIEF DESCRIPTION OF DRAWINGS

The present invention is illustrated by way of example with reference to the accompanying drawings wherein.

DETAIL DESCRIPTION OF PREFERRED EMBODIMENTS

Figure 2:
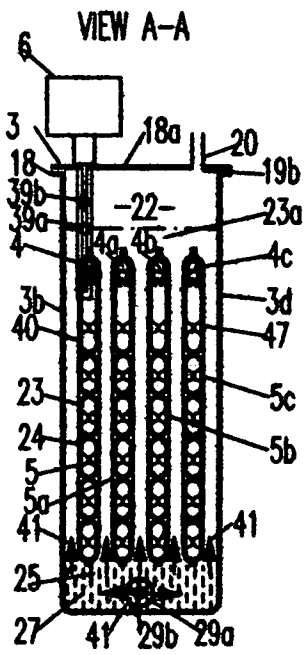
FIG. 2 is a sectional view essentially along line A-A of a preferred embodiment of the water tank of the present invention shown in FIG. 1.
Figure 1:
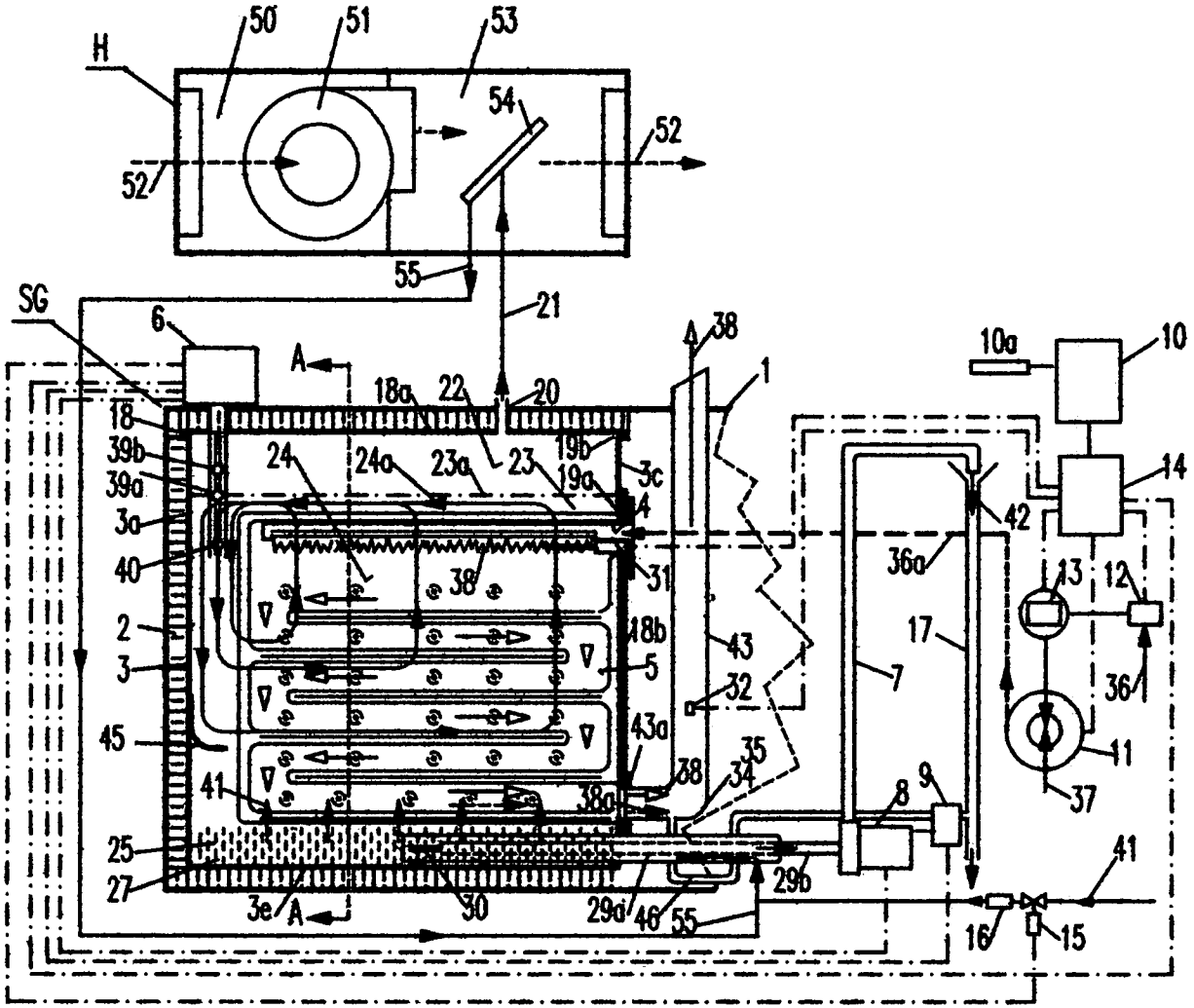
FIG. 1 is a schematic illustration of a preferred embodiment of a compact steam generator of the present invention in combination with an air humidifier in humidifying of space air.
Figure 5:
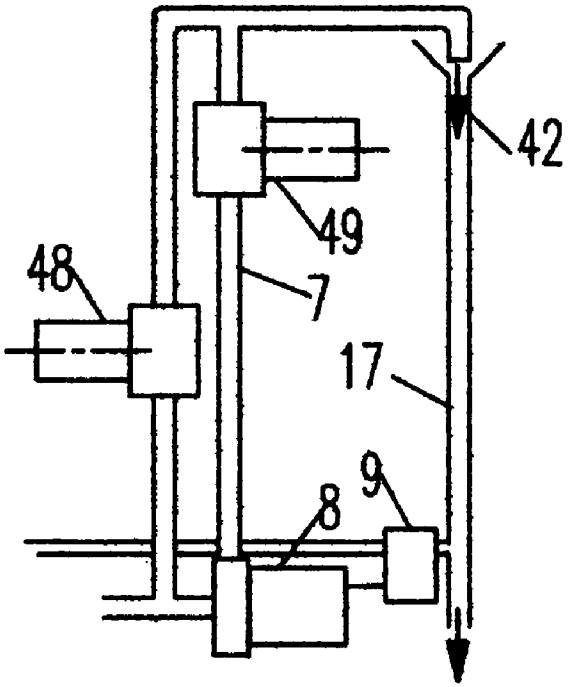
FIG. 5 is a schematic illustration of another preferred embodiment of a pressure relief arrangement that may be used instead of a water seal shown in FIG. 1.

Schematically illustrated in FIG. 1, and FIG. 2 is an air humidifying system comprising a humidifier H and a compact steam generator SG for humidifying space air in a building, with the humidifier H carrying out the air humidifying process and the steam generator SG producing the steam used in the humidifier H.

The humidifier H includes an intake compartment 50 for housing an air fan 51 provided for intake and discharge of the building space air 52 into and through the discharge compartment 53 back into the building space. Compartment 53 includes a steam distributor 54 provided for distribution of steam 21 into the space air 52 with a conduit 55 for returning condensate from the steam distributor 54 back to water tank 3.

Various arrangements for distribution of steam and steam injector systems for humidifying of air in a stand alone humidifiers and in air ducts of central heating-ventilation-airconditioning systems of buildings are known and are commercially available. They are not the object of this invention and are not further described herein.

The steam generator SG of the embodiment of the present invention illustrated in FIGS. 1, 2, 3 and FIG. 4 produces a substantially atmospheric pressure steam and includes: a casing 1 provided with thermal insulation 2, a water tank 3, burners 4, 4*a*, 4*b*, and 4*c*, heat exchanger elements 5, 5*a*, 5*b*, 5*c*, water level controller 6, water seal 7, water pump 8, timer with a variable time delay relay 9, humidistat 10, air blower 11, gas valve 12, proportional gas regulator 13, combustion controls 14, feed water solenoid valve 15, flow restrictor 16 and a drain pipe 17.

The water tank 3 is a sealed flanged type tank of stainless steel of a rectangular shape having sidewalls 3*a*, 3*b*, 3*c*, 3*d* and a bottom wall 3*e*, having a sealed openings 19*a* in the side wall 3*c* for i heat exchanger elements 5, 5*a*, 5*b*, 5*c* into the water tank 3 and a sealed opening 19*b* at the top provided with a top flange 18 and tank cover 18*a* for seasonal clean up of the water tank 3 and heat exchanger elements 5, 5*a*, 5*b*, and 5*c*. It is designed to operate at substantially atmospheric pressure. The water tank cover 18*a* has a steam outlet 20 for discharging steam 21.

The water tank 3 has a designated steam separation zone 22 for separation of produced steam 21 from boiling water 23, a boiling zone 24 for housing heat exchanger elements 5, 5*a*, 5*b*, and 5*c* and boiling, circulating and evaporating the boiling water and precipitating dissolved solids from the boiling water circulating in the direction of arrows 24*a* and a solids separation zone 25 for separating solids 26 (not shown) from boiling water 23 into a suspension 27 of solids and water in solids separation zone 25.

The boiling zone 24 may be provided with a baffle 45, to direct the circulation of boiling water as indicated by arrows 24*a* and to minimize turbulence in solids separation zone 25. Conduit 29*a* with screen 30 located in solids separation zone 25 is provided for feeding cold make up water 41 to cool the suspension 27 and conduit 29*b* for automatic intermittent blow down and discharge of the cooled suspension 27 by water pump 8 through conduit 7 to drain 17.

With high rate internal circulation of boiling water 23 and removal of solids from the boiling water in accumulation zone 25 formation of the hard scale on the flat heat transfer surfaces of the stainless steel heat exchanger elements 5, 5*a*, 5*b* and 5*c* is minimized and with automatic intermittent blow down and discharge of the cooled suspension 27 together with the incoming cold make up water 41 a long unattended operation of the steam generator SG is maintained.

The burners 4, 4*a*, 4*b* and 4*c* are commercially available tubular burners for burning a mixture 36*a* of gaseous fuel 36 and air 37 for producing combustion products 38 including the heat required for the production of steam 21. They are inserted in heat exchanger elements 5, 5*a*, 5*b*, and 5*c* and include igniter 31, (31*a*, 31*b*, and 31*c*, not shown) for starting up and maintaining the combustion of fuel. The gaseous fuel 36 is provided by gas valve 12 with the flow rate of the gaseous fuel controlled by gas regulator 13. The combustion air 37 is provided by air blower 11 and the combustion of the mixture 36*a* of the gaseous fuel 36 and air 37 in burners 4, 4*a*, 4*b*, and 4*c* is controlled by combustion controls 14 in combination with the humidistat 10 and water level controller 6. For a wider range of operating capacities one may use a conventional modulating constant air/fuel ratio valve train (not shown). A conventional commercially available induced draft combustion system replacing the described forced air combustion system may be also used.

Figure 4:
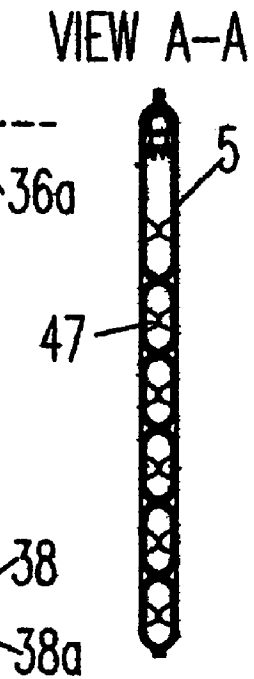
FIG. 4 is a sectional view essentially along line A-A of the heat exchanger shown in FIG. 3.
Figure 3:
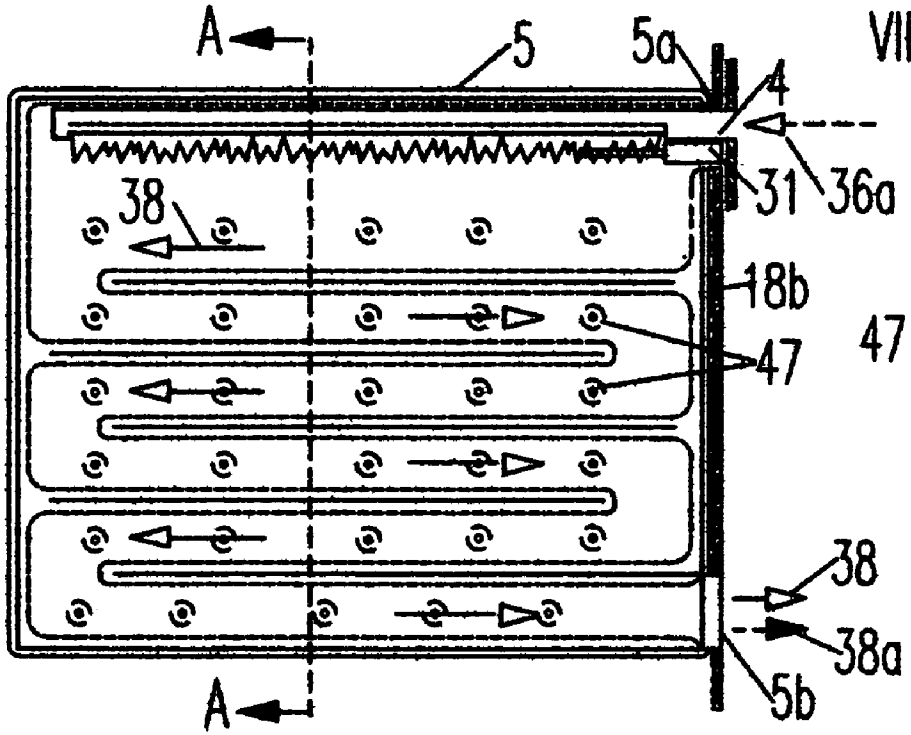
FIG. 3 is a schematic illustration of a preferred embodiment of the flat tubular type heat exchanger with the tubular burner of the steam generator of the present invention shown in FIG. 1.

The flat tubular type heat exchanger 5 shown in FIG. 3 and FIG. 4 has a flat extended heat transfer surface made of stainless steel sheet metal. It has a flange 18*b* for connection to the side wall 3*c* of water tank 3, an opening 5*a* for inserting a commercially available ribbon type burner 4, turbulators 47 for increasing the convective heat transfer rate and reinforcing the heat exchanger and an opening 5*b* for discharging cooled combustion products 38 and condensed moisture 38*a* into duct 43. It is designed to transfer the required heat from combustion products 38 passing downwardly there through to the boiling water 23 to produce the required amount of steam in boiling zone 24 and to preheat the incoming cold make up water in solids separation zone 25 while cooling the combustion products and condensing the moisture 38*a* present in combustion products 38. With the properly designed heat exchanger 5 the overall thermal efficiency of the steam generating system of the present invention of up to 95% is feasible. The cooled combustion products 38 are discharged through duct 43 to outdoors and the condensate 38*a* is drained from duct 43 via a water trap and conduit 46 to drain 17. A conventional temperature limit switch 32 interconnected with combustion controls 14 is located in the flue gas discharge duct 43 to protect the steam generator SG by interrupting the combustion process upon reaching an overheat situation in flue gas discharge duct 43.

The water level controller 6 is a commercially available device that includes water level switches 39*a*, 39*b* and 40 for controlling the water level in water tank 3. The level switch 39*a* maintains the water level 23*a* of boiling water 23 by opening and closing the solenoid valve 15 controlling the flow of cold make up water 41 through a flow restrictor 16, conduit 29*a* and screen 30 into the solids separation zone 25. Other types of water level controllers are available on the market and if desired, may be used with the same result.

The water level switch 39*b* is interconnected with solenoid valve 15 to interrupt the flow of make up water when the water level in the water tank 3 for some unexpected reason reaches the float switch 39*b*.

The water level switch 40 is interconnected with combustion controls 14 to initiate the combustion process when the water level in the water tank 3 reaches the float switch 40 and to interrupt the combustion process when the water level in the water tank 3 for some unexpected reason drops below the float switch 40.

Figure 6:
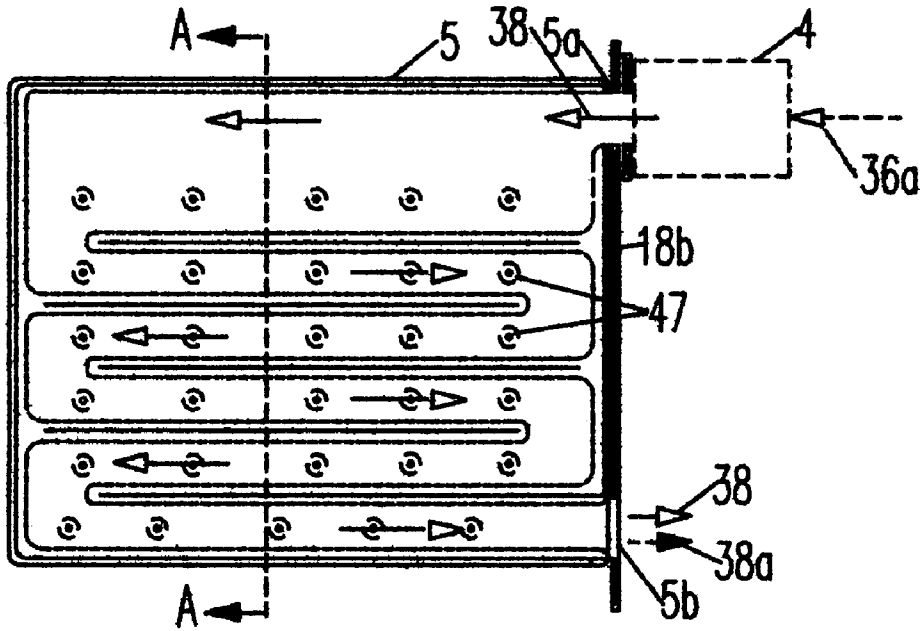
FIG. 6 is a schematic illustration of the flat tubular type heat exchanger shown in FIG. 3 with a commercial premix burner connected to the intake opening of the heat exchanger.

The water seal 7 may be a conventional steel or plastic pipe in direct communication through the water pump 8 and conduit 29*b* with solids separation zone 25 of water tank 3 and protects the water tank 3 against an accidental increase in operating pressure. An optional arrangement is shown in FIG. 6 wherein the water seal 7 is replaced with a pressure relief valve 48 and the conduit 7 is provided with solenoid valve 49 operated in parallel with the water pump 8.

The water pump 8 is a commercially available centrifugal water pump and its operation is controlled by a timer 9 provided with variable time delay relay. It also may be controlled by the water level switch 40. It provides an automatic intermittent blow down of the cooled suspension 27 from solids separation zone 25 to drain pipe 17. The timing of the operation of the water pump depends on the concentration of total solids in make up water 41 and the volume of make up water processed in the water tank 3.

The humidistat 10 with a humidity sensor 10*a* measures and monitors the humidity of the building space air 52 and controls the production of steam through combustion controls 14 maintaining the combustion of fuel-air mixture 36*a* in burners 4, 4*a*, 4*b* and 4*c*. Depending on design objective, humidistat 10 may be either an ON-OFF type for controlling a periodic air humidifying process in humidifier H, or a modulating type for controlling a continuous air humidifying process.

The air blower 11 is a commercially available unit provided for delivering combustion air 37 and fuel 36 at the required pressure to burners 4, 4*a*, 4*b* and 4*c* and is controlled by combustion controls 14.

The gas valve 12 is a commercially available solenoid gas valve controlled by combustion controls 14. Depending on the type of the desired humidifying process carried out in humidifier H the gas valve 12 may be an ON-OFF type solenoid valve for use with an ON-OFF type humidistat or a proportional or a modulating gas valve for use with a modulating type humidistat.

The proportional gas valve 13 is a commercially available valve controlled by combustion controls 14 and is controlling the flow rate of the gaseous fuel 36 to blower 11.

The combustion controls 14 are of a commercial type used in conventional combustion systems.

The solenoid valve 15 is a commercially available on-off solenoid valve and is provided to control the flow of make up water 41 into water tank 3.

The flow restrictor 16 is an orifice maintaining a constant flow rate of make up water 41 into the solids separation zone 25 of water tank 3 and may be built into the solenoid valve 15.

FIG. 6 shows the flat tubular type heat exchanger 5 of the present invention with a commercially available burner 4 connected to the intake opening 5*a* of the heat exchanger with the operation of the heat exchanger being the same as that described in the embodiment shown in FIG. 1, and FIG. 2.

Figure 7:
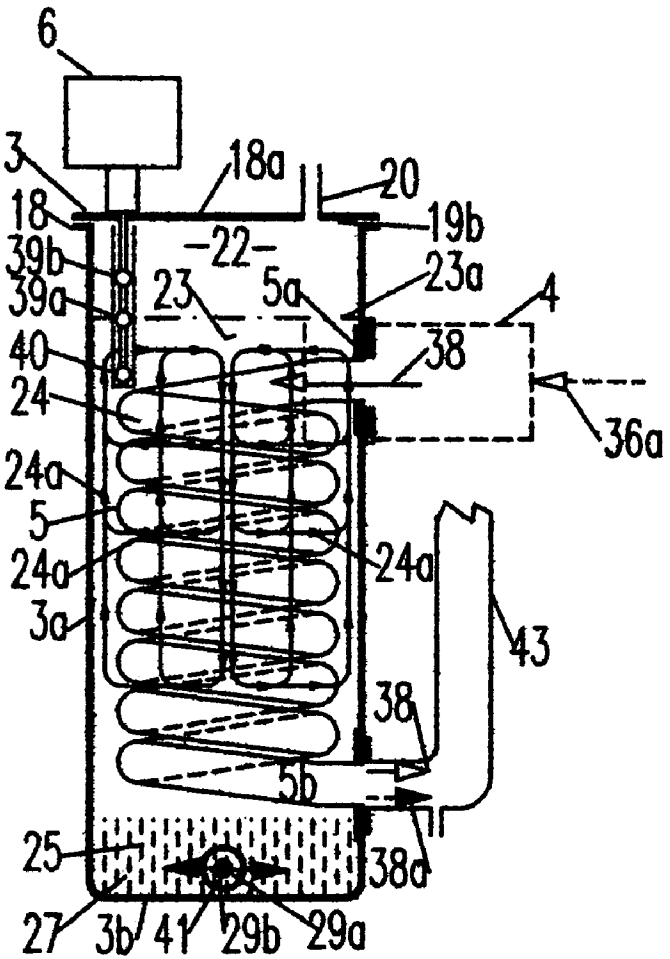
FIG. 7 is another preferred embodiment of the present invention wherein the water tank is of a cylindrical shape with a commercial premix burner connected to the intake opening of a conventional coil type heat exchanger.

FIG. 7 shows another preferred arrangement of the present invention wherein the water tank 3 is of a cylindrical shape and the tubular heat exchanger 5 is made of a stainless steel tube shaped into a conventional coil type heat exchanger that is immersed in the water tank 3 and to which a commercially available burner 4 is connected at the intake opening 5*a* of the heat exchanger 5. The function of the water tank 3 and the coil type heat exchanger 5 is the same as that described in the embodiment of the invention of FIG. 1, and FIG. 2.

While the present invention is described in an embodiment that includes an air humidifier H for humidifying the space air in a building, it can be appreciated by those with skills in the art, that the described steam distributor 54 in discharge compartment 53 of Humidifier H may be replaced with a conventional steam condenser (not shown) and the humidistat 10 may be replaced with a termostat (not shown) for heating of the building air or that a conventional steam condenser may be added into the discharge compartment 53 to provide a simultaneous heating and humidifying of the building air, or that the humidifier H may be replaced by an industrial process apparatus requiring steam. In such applications the described steam generator will produce steam on steam demand measured and controlled by a humidistat or by a thermostat or by a pressure controller.

While the present invention is described with four vertical flat tubular type heat exchanger elements in a rectangular water tank and with a tubular coil type heat exchanger in cylindrical water tank it can be appreciated by those with skills in the art, that to meet a desired production capacity there may be a single or more such tubular type heat exchanger elements installed in an appropriately sized rectangular or cylindrical water tank, or that such flat tubular elements may be replaced with heating elements of a different physical shape to accommodate different burners to achieve the same results, or a desired capacity, or a desired physical shape of the steam generator SG.

While the present invention is described in an embodiment with heat exchanging elements operating in a condensing mode to achieve the 95% ultra-high thermal efficiency of the steam generator, it can be appreciated by those with skills in the art, that if desired the described heat exchanging elements also can effectively operate in a non-condensing mode.

While the present invention is described in an embodiment without a monitor displaying the operation of the apparatus, it can be appreciated by those with skills in the art, that if desired, a monitor including sensors, processors, clock, timer, and displays may be provided to display the performance and operation of the described steam generating-humidifying system.

While the present invention is described in an embodiment that uses as a source of the required heat a gaseous fuel it can be appreciated by those with skills in the art, that if desired, the described gaseous fuel may be conveniently replaced with liquid fuel to achieve the same or an improved result.

While the present invention is described in an embodiment that uses substantially constant water level of the boiling water in the water tank, it can be appreciated by those with skills in the art that if desired the water level may be varied between a preset high-low water level limits to achieve the same results.

The method used to produce steam in steam generator SG of the present invention of the embodiment of FIG. 1, 2 and FIG. 7 from cold make up water containing dissolved solids includes the following steps:

a) maintaining the water in water tank at a preselected level,
b) feeding cold make-up water into solids separation zone of the water tank,
c) burning a mixture of gaseous fuel with air to produce combustion products,
d) passing combustion products downwardly through heat exchanger in an indirect heat exchange relationship with water thereby producing steam, circulating the boiling water, precipitating dissolved solids and cooling combustion products in boiling zone,
e) passing cold make-up water upwardly through solids separation zone into boiling zone in an indirect heat exchange relationship with combustion products passing downwardly through heat exchanger thereby recovering latent heat and condensing the moisture present in combustion products and preheating the make-up water,
f) discharging cooled combustion products to outdoors,
g) discharging collected condensate to drain,
h) separating produced steam from said boiling water,
i) discharging said produced steam out of water tank,
j) separating precipitated solids from boiling water by gravitational separation enhanced by circulation of boiling water into a suspension accumulating in solids separation zone,
k) cooling the suspension in solids separation zone by the cold make up water passing there through into boiling zone, and
l) intermittently blowing down a predetermined quantity of cooled suspension of solids with cold make up water to drain.

Operation of the compact steam generator SG of the embodiment of the present invention illustrated in FIG. 1 and FIG. 2 is as follows.

The humidistat 10 located in a building continuously measures the humidity and the humidity load demand of the building air 52. On call for humidity from the humidistat 10, if for some reason the water level in the water tank 3 is below the flow switch 40 of the water controller 6, the water level controller opens the solenoid valve 15 to start the flow of the make up water 41 into the solids separation zone 25 cooling the suspension of solids 27 therein and rising the water level in the water tank 3. When the water in water tank 3 reaches the water level switch 40 the water level controller 6 in combination with combustion controls 14 initiate the combustion of fuel-air mixture 36*a* in burners 4, 4*a*, 4*b* and 4*c* and starts the circulation of the space air through humidifier H by the air fan 51. The produced heat is being transferred first to the boiling water in the boiling zone 24 for boiling, circulating and evaporating the boiling water, then to preheat the feed water in the solids separation zone 25. The produced steam 21 is leaving the water tank 3 via outlet 20 to be distributed into space air 52 in humidifier H by steam distributor 54.

The water level 23*a* of the boiling water in water tank 3 is maintained by the float switch 39*a* by closing and opening the solenoid valve 15. As make up water evaporates the present dissolved solids are concentrated and precipitated and the precipitated solids are separated from the circulating boiling water and accumulated in solids separation zone 25 as a suspension 27 of solids and cold make up water.

As the cold make up water passes through solids separation zone 25 upwardly to boiling zone 24 in an indirect heat exchange relationship with the combustion products 38 passing downwardly through heat exchanger elements 5, 5*a*, 5*b*, and 5*c* it is cooling the suspension 27 and combustion products 38 and condensing moisture 38*a* from combustion products while it is being preheated before entering the boiling zone 24.

After enough solids have been accumulated in separation zone 25, a timer with preset time starts the water pump 8 to blow down the cooled suspension 27 via screen 30, conduit 29*b* and water seal pipe 7 to drain pipe 17. During the blow down operation the production of steam in the steam generator continues at the rate required by the humidistat 10 to humidify the air 52 passing through humidifier H.

Regardless of the quality of the make up water, the steam generator SG of the embodiment of the present invention shown in FIG. 1 and FIG. 2 is producing steam at a rate required to satisfy the humidify demand of the treated air in an unattended operation at overall thermal efficiency of up to 95%.

SUMMARY OF THE DISCLOSURE

In summary of this disclosure, the present invention provides a high efficiency compact steam generator and a method for producing steam from cold make up water containing dissolved solids.

The steam is produced in a water tank with a designated steam separation zone, boiling zone and a solids separation zone. The required heat is produced by combustion of a gaseous fuel in commercially available burners. The heat is transferred to the water in the water tank by passing combustion products downwardly through tubular type heat exchanger elements immersed in the water thereby recovering the radiation, sensible and latent heat of combustion products. The produced steam is separated from the boiling water in the steam separation zone and the precipitated solids are separated from the boiling water and accumulated in a solids separation zone. The solids are cooled by the cold make up water and intermittently discharged together with the incoming cold make up water from solids separation zone by a water pump to drain, the cold make up water is preheated by combustion products passing through the heat exchanger in solids separation zone by recovering sensible and latent heat of combustion products and the collected condensed moisture of combustion products is discharged to drain.

Suitable controls are provided to maintain automatic unattended operation of the steam generator to satisfy steam demand measured by a suitable sensor.

While the present invention has been described with reference to specific embodiments and in specific applications to demonstrate the features and advantages of the present invention, such specific embodiments are susceptible to modifications to fit other configurations or other applications. Accordingly, the forgoing description is not to be construed in a limiting sense.

What is claimed is:

1. A compact apparatus comprising:

a) a water tank defining a closed chamber for holding a preselected quantity of water and heat exchanger means immersed in said water and spaced from the bottom of said water tank therein and having a boiling zone defined by the free upper surface of said water and said heat exchanger means for boiling and circulating said water therein, a steam separation zone defined by said free upper surface of said water and the top of said water tank for separating steam from said boiling water therein and a solids separation zone defined by said bottom of said water tank and said heat exchanger means for separating and accumulating solids from said boiling water therein, said steam separation zone having steam outlet means for discharging said steam, said solids separation zone having inlet opening means for incoming cold make up water and return condensate and outlet opening means for blowing down said solids and draining said water from said water tank and said water tank having a flanged opening means for installing said heat exchanger means and a separate flanged opening means for cleaning said water tank and said heat exchanger means, b) said heat exchanger means having inlet and exit opening means for passing combustion products through said heat exchanger means in an indirect heat exchange relationship with said water in said water tank thereby preheating said incoming cold make up water and heating circulating and boiling said water while cooling said combustion products, c) burner means being located inside said heat exchanger means for burning fuel with combustion air to produce said combustion products, d) means for delivering said fuel and combustion air to said burner means, e) means for controlling said combustion of said fuel with said air in said burner means, f) exhaust outlet conduit means communicating with said exit opening means of said heat exchanger means for discharging said cooled combustion products, g) means for feeding said cold make up water and return condensate into said solids separation zone, h) means for maintaining a level of said water in said water tank within preset water level limits, i) means for withdrawing said solids from said solids separation zone, j) means for draining said water from said water tank, k) means for protecting said water tank against an accidental increase in operating pressure, l) means for protecting said water tank against an accidental increase in operating temperature, m) means for controlling and maintaining production of said steam in response to a steam demand measured by steam demand sensor means, and n) a heat insulation surrounding said water tank and a casing for housing said compact apparatus.

2. A compact apparatus of claim 1 wherein said means for delivering said fuel and combustion air to said burner means include gas valve means and blower means for forcing a mixture of a proper ratio of fuel and combustion air into said burner means and said combustion products through said heat exchanger means and said exhaust conduit means.

3. A compact apparatus of claim 2 including in addition humidifying means including steam distributor means for humidifying air and means directing said steam thereto from said steam outlet means, with condensate collected in said steam distributor means being returned to said solids separation zone wherein said steam demand sensor means is a humidistat.

4. A compact apparatus of claim 1 wherein said means for delivering said fuel and combustion air to said burner means include gas valve means and exhaust fan means for drawing a mixture of a proper ratio of fuel and combustion air into said burner means and said combustion products through said heat exchanger means and said exhaust conduit means.

5. A compact apparatus of claim 4 including in addition humidifying means including steam distributor means for humidifying air and means directing said steam thereto from said steam outlet means, with condensate collected in said steam distributor means being returned to said solids separation zone wherein said steam demand sensor means is a humidistat.

6. A compact apparatus of claim 1 with said heat exchanger means disposed in said water tank substantially vertically and having said inlet opening means located at the top and said exit opening means located at the bottom of said heat exchanger means for passing said combustion products downwardly through said heat exchanger means, with said cold make up water passing upwardly through said solids separation zone into said boiling zone in direct heat transfer relationship with said solids and said water present in said solids separation zone thereby cooling said solids and said water in said solids separation zone and in an indirect heat transfer relationship with said combustion products passing downwardly through said heat exchanger means thereby preheating said make up water and cooling and recovering latent heat and condensing moisture present in said combustion products and including in addition conduit means for discharging said condensed moisture to drain.

7. A compact apparatus of claim 6 wherein said means for delivering said fuel and combustion air to said burner means include gas valve means and blower means for forcing a mixture of a proper ratio of fuel and combustion air into said burner means and said combustion products through said heat exchanger means and said exhaust conduit means.

8. A compact apparatus of claim 7 including in addition humidifying means including steam distributor means for humidifying air and means directing said steam thereto from said steam outlet means, with condensate collected in said steam distributor means being returned to said solids separation zone wherein said steam demand sensor means is a humidistat.

9. A compact apparatus of claim 6 wherein said means for delivering said fuel and combustion air to said burner means include gas valve means and exhaust fan means for drawing a mixture of a proper ratio of fuel and combustion air into said burner means and said combustion products through said heat exchanger means and said exhaust conduit means.

10. A compact apparatus of claim 9 including in addition humidifying means including steam distributor means for humidifying air and means directing said steam thereto from said steam outlet means, with condensate collected in said steam distributor means being returned to said solids separation zone wherein said steam demand sensor means is a humidistat.

11. A compact apparatus of claim 9 including in addition air heating means including steam condenser means for heating air and means directing said steam thereto from said steam outlet means, with condensate collected in said steam condenser means being returned to said solids separation zone wherein said steam demand sensor means is a thermostat.

12. A compact apparatus comprising:

a) a water tank defining a closed chamber for holding a preselected quantity of water and heat exchanger means immersed in said water and spaced from the bottom of said water tank therein and having a boiling zone defined by the free upper surface of said water and said heat exchanger means for boiling and circulating said water therein, a steam separation zone defined by said free upper surface of said water and the top of said water tank for separating steam from said boiling water therein and a solids separation zone defined by said bottom of said water tank and said heat exchanger means for separating and accumulating solids from said boiling water therein, said steam separation zone having steam outlet means for discharging said steam, said solids separation zone having inlet opening means for incoming cold make up water and return condensate and outlet opening means for blowing down said solids and draining said water from said water tank and said water tank having a flanged opening means for installing said heat exchanger means and a separate flanged opening means for cleaning said water tank and said heat exchanger means, b) said heat exchanger means having inlet and exit opening means for passing combustion products through said heat exchanger means in an indirect heat exchange relationship with said water in said water tank thereby preheating said incoming cold make up water and heating circulating and boiling said water while cooling said combustion products, c) burner means being located on the outside of said water tank and communicating with said intake opening means of said heat exchanger means for burning fuel with combustion air to produce said combustion products, d) means for delivering said fuel and combustion air to said burner means e) means for controlling said combustion of said fuel with said air in said burner means, f) exhaust outlet conduit means communicating with said exit opening means of said heat exchanger means for discharging said cooled combustion products, g) means for feeding said cold make up water and return condensate into said solids separation zone, h) means for maintaining a level of said water in said water tank within preset water level limits, i) means for withdrawing said solids from said solids separation zone, j) means for draining said water from said water tank, k) means for protecting said water tank against an accidental increase in operating pressure, l) means for protecting said water tank against an accidental increase in operating temperature, m) means for controlling and maintaining production of said steam in response to a steam demand measured by steam demand sensor means, and n) a heat insulation surrounding said water tank and a casing for housing said compact apparatus.

13. A compact apparatus of claim 12 with said heat exchanger means disposed in said water tank substantially vertically and having said inlet opening means located at the top and said exit opening means located at the bottom of said heat exchanger means for passing said combustion products downwardly through said heat exchanger means, with said cold make up water passing upwardly through said solids separation zone into said boiling zone in direct heat transfer relationship with said solids and said water present in said solids separation zone thereby cooling said solids and said water in said solids separation zone and in an indirect heat transfer relationship with said combustion products passing downwardly through said heat exchanger means thereby preheating said make up water and cooling and recovering latent heat and condensing moisture present in said combustion products and including in addition conduit means for discharging said condensed moisture to drain.

14. A compact apparatus of claim 13 wherein said means for delivering said fuel and combustion air to said burner means include gas valve means and blower means for forcing a mixture of a proper ratio of fuel and combustion air into said burner means and said combustion products through said heat exchanger means and said exhaust conduit means.

15. A compact apparatus of claim 14 including in addition humidifying means including steam distributor means for humidifying air and means directing said steam thereto from said steam outlet means, with condensate collected in said steam distributor means being returned to said solids separation zone wherein said steam demand sensor means is a humidistat.

16. A compact apparatus of claim 13 wherein said means for delivering said fuel and combustion air to said burner means include gas valve means and exhaust fan means for drawing a mixture of a proper ratio of fuel and combustion air into said burner means and said combustion products through said heat exchanger means and said exhaust conduit means.

17. A compact apparatus of claim 16 including in addition humidifying means including steam distributor means for humidifying air and means directing said steam thereto from said steam outlet means, with condensate collected in said steam distributor means being returned to said solids separation zone wherein said steam demand sensor means is a humidistat.

18. A compact apparatus of claim 16 including in addition air heating means including steam condenser means for heating air and means directing said steam thereto from said steam outlet means, with condensate collected in said steam condenser means being returned to said solids separation zone wherein said steam demand sensor means is a thermostat.

19. A method for producing steam from cold make up water containing dissolved solids in a water tank steam generator, said method comprising the following steps:

a) maintaining a preselected quantity of water in said water tank steam generator, b) burning fuel to produce combustion products, c) passing said combustion products through heat exchanger means in an indirect heat exchange relationship with said water thereby producing steam, circulating boiling water and precipitating said dissolved solids and cooling said combustion products, d) separating said precipitated solids from said circulating boiling water and accumulating solids at the bottom of said water tank steam generator, c) feeding said cold make up water at the bottom into said water tank steam generator and passing said cold make up water upwardly into said circulating boiling water in a direct heat exchange relationship with said accumulated solids and said water thereby cooling said accumulated solids and said water and in an indirect heat exchange relationship with said combustion products passing through said heat exchanger means thereby preheating said cold make up water and cooling said combustion products, d) discharging said cool combustion products out of said water tank steam generator, e) separating said produced steam from said boiling water, f) discharging said produced steam out of said water tank steam generator, and g) intermittently blowing down a predetermined quantity of said accumulated solids.

20. A method for producing steam as set forth in claim 19 that includes in addition following steps:

a) passing said combustion products downwardly through said heat exchanger means immersed substantially vertically in said water in an indirect heat exchange relationship with said water thereby producing steam, circulating boiling water and precipitating said dissolved solids and cooling said combustion products, b) passing said cold make up water upwardly through said steam generator in an indirect heat exchange relationship with said combustion products passing downwardly through said heat exchanger means thereby recovering latent heat of combustion products, condensing moisture in said combustion products and preheating said cold make up water, and c) separating said condensed moisture from said combustion products and discharging said condensed moisture to drain.

* * * * *